United States Patent [19]

Kobayashi

[11] 4,335,062

[45] Jun. 15, 1982

[54] CARBURETOR WITH ROTARY THROTTLE

[75] Inventor: Hiroto Kobayashi, Kamakura, Japan

[73] Assignee: Walbro Far East, Inc., Kawasaki, Japan

[21] Appl. No.: 156,179

[22] Filed: Jun. 3, 1980

[30] Foreign Application Priority Data

Jun. 6, 1979 [JP] Japan ..... 54-075883[U]

[51] Int. Cl.[3] ..... F02M 9/08

[52] U.S. Cl. ..... 261/44 G; 261/DIG. 55; 261/99

[58] Field of Search ..... 261/44 G, 65, DIG. 55, 261/DIG. 39, 95, 99

[56] References Cited

U.S. PATENT DOCUMENTS

| | | | |
|---|---|---|---|
| 1,259,105 | 3/1918 | Joret | 261/44 G |
| 1,857,565 | 5/1932 | Pahl et al. | 261/99 |
| 2,177,853 | 10/1939 | Wills | 252/12.2 |
| 2,430,841 | 11/1947 | Wulfhorst | 261/99 |
| 2,926,007 | 2/1960 | Pettit | 261/44 G |
| 3,439,903 | 4/1969 | Tolnai | 261/89 |
| 4,269,793 | 5/1981 | Ibbott | 261/95 |

FOREIGN PATENT DOCUMENTS

| | | | |
|---|---|---|---|
| 707019 | 4/1954 | United Kingdom | 261/44 G |

*Primary Examiner*—Tim R. Miles

*Attorney, Agent, or Firm*—Barnes, Kisselle, Raisch & Choate

[57] ABSTRACT

A carburetor for small engines which can be used in all positions utilizes a cylindrical rotary throttle valve with a venturi opening and provides a porous material as a part of the throttle valve, either as the entire material for the valve, or as a sleeve surrounding the venturi portion. During idling the fuel which might collect in a pocket in the valve is absorbed into the porous material and sucked into the engine, thus avoiding the disadvantages of liquid fuel being dumped into the engine when the position of the carburetor is changed.

1 Claim, 5 Drawing Figures

CARBURETOR WITH ROTARY THROTTLE

REFERENCE TO RELATED APPLICATION

Reference is made to my copending application, entitled "An Auxiliary Fuel Supply Device for Internal Combustion Engines," Ser. No. 156,167, filed simultaneously with this application.

FIELD OF INVENTION

Carburetors utilizing rotary throttles having cylindrical shapes with a venturi bore on a diameter of the cylinder, the throttle valve being constructed of porous material.

BACKGROUND OF THE INVENTION

The invention pertains to a carburetor for an internal combustion engine, particularly a two-cycle engine which is provided with a suitable rotary throttle valve and used as the driving power source for chain saws and trimmers.

It is known to use, for internal combustion engines, a carburetor with a cylindrical rotary throttle valve. By rotation of the rotary throttle valve, it is possible to change the effective diameter of the air passage serving as the venturi bore which opens in the direction of the diameter of the throttle valve, and which cooperates with the air passage that is provided in the carburetor body in which the throttle valve is located. In rotating the throttle valve, the quantity of the fuel from the fuel nozzle entering the venturi bore can be controlled. This rotating operation of the throttle valve of the carburetor provides excellent engine response in normal operation of the internal combustion engine.

However, when the throttle valve is in an idling position, the intake air flow speed through the venturi bore diminishes, and thus reduces the fuel atomization. When an engine is idling at a certain position of the carburetor, it is difficult to provide a proper fuel supply to the internal combustion engine through the nozzle. This causes a quantity of liquid fuel to collect in the venturi bore. With the exception of the idling function, the carburetor, regardless of its position, can control an internal combustion engine very effectively and with good response. But as pointed out, the operating efficiency at idling in certain positions is not ideal. In particular, when said carburetor position is in an upside down position, liquid fuel may collect in the venturi bore and then on occasion be quickly sucked into the internal combustion engine which may cause the engine to stop.

Because of this problem, the existing carburetor with the rotary throttle valve cannot be utilized with an internal combustion engine of a chain saw or trimmer which is expected to maintain good performance at any and all positions of the carburetor. Therefore, its application area has been limited.

The objective in this invention is to eliminate this defect of the rotary throttle valve carburetor and to offer a new rotary throttle system carburetor which can properly control an internal combustion engine in any position through the stages of full throttle or idling.

The invention relates to a cylindrical throttle in general and the venturi bore opens in the direction of the diameter of the cylinder. The outside of the throttle valve, where said venturi bore of the rotary throttle valve opens, is provided with porous material.

The distinctive feature of the invention is that while idling at certain positions, when fuel tends to collect in the venturi bore, the porous material will absorb liquid fuel and prevent fuel collection in the venturi bore.

The novelty of the invention can be further made clear by the following explanation and in the drawings which illustrate various embodiments.

BRIEF DESCRIPTION OF THE DRAWINGS

DRAWINGS accompany the disclosure and the various views thereof may be briefly described as.

DETAILED DESCRIPTION OF THE INVENTION

Figure 1:
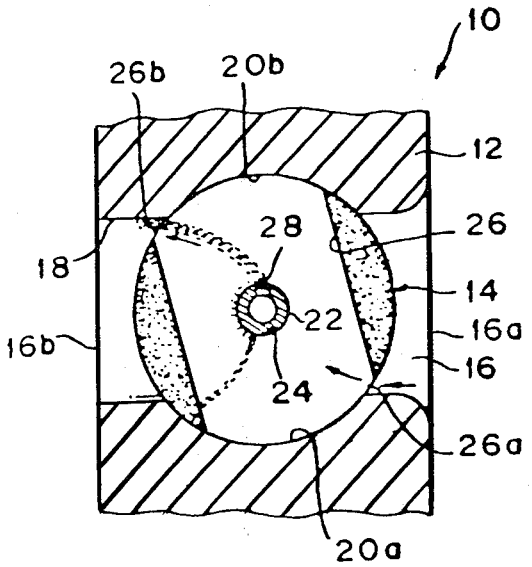
FIG. 1, a vertical section of a portion of a carburetor embodying the invention.

A portion of a carburetor body incorporating the invention is generally shown at 10 in FIG. 1. The carburetor is composed of a carburetor body 12 and a cylindrical rotary throttle valve 14 assembled into the carburetor body.

An air passage 16 which perforates the body 12 has one end **16*b* which would be connected with an air cleaner (not illustrated) exposed to atmospheric air, while the other end 16*b* of the passage 16 is connected to an air intake opening (not illustrated) of an internal combustion engine. On opposite sides of the circumference 18 which forms the air passage 16 are formed a pair of concavities 20*a* and 20*b* in an arc to fit the exterior circumference of the throttle valve 14. The throttle valve is disposed across the air passage 16** and is operative in said passage.

The cylindrical rotary throttle valve 14 that is operative in said concavities **20*a* and 20*b* is composed of porous material such as cast metal including copper, stainless steel, etc. It is desired to use the cast metal material with porosity holes having a diameter of $2\mu$ to $120\mu$ which is commonly used as a filter material. The throttle valve 14**, in lieu of said cast metal material, can be built with various porous materials which are not deteriorated by oil.

Figure 2:
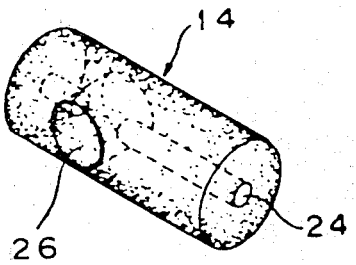
FIG. 2, a perspective view of the throttle valve of FIG. 1.

As shown in FIG. 2, the throttle valve 14 has a hole 24 drilled along the center line of the axis of the cylinder in order to receive a fuel nozzle 22, as shown in FIG. 1, while the venturi bore 26 is perforating through said throttle valve 14 across the hole 24.

From the fact that said throttle valve 14 is of porous material, the whole exterior circumference between one end and the other, including the exterior circumference where the venturi bore 26 opens, is formed of porous material. As shown in FIG. 1, the throttle valve 14 is made to fit rotatively in the concavities **20*a*, 20*b*** so that its exterior circumference is in contact with the face of the concavities.

In the hole 24 of the throttle valve 14, the fuel nozzle 22 is located and it has an emission orifice 28 arranged in an upward direction, as shown in FIG. 1, the nozzle 22 being stationary in the carburetor body 12. This emission orifice 28 of the nozzle can be moved to any desired direction. Fuel is supplied to the nozzle 22 by a constant pressure mechanism integrated into said carburetor body 12 as is well known although not illustrated.

FIG. 1 shows the throttle valve 14 at idling opening position. At this idling opening position, and in order to control the effective diameter of the air passage 16, one end of the opening 26*a* of said venturi bore 26 should be kept slightly open to the atmosphere end of said air passage 16 at the concavity 20*a*, while the other end of the opening at 26*b* should be kept open slightly on the internal combustin engine side of said air passage 16 at the other concavity 20*b*. The throttle valve 14, in accordance with standard practice, is movable counterclockwise as shown in FIG. 1, to adjust the venturi bore 26 relative to theair passage 16 by moving a throttle control lever (not illustrated) installed on the exterior of the carburetor body 12.

By moving the lever, the effective diameter of the air passage 16 can be enlarged. When the lever is released, the throttle valve 14 can be maintained at the idling opening position as mentioned above.

With said carburetor 10 as regards the present invention, when the throttle valve is in idling position, as shown in FIG. 1, the air current flows from one end opening 26*a* of said venturi bore 26 in the direction of the suction pipe opening of the engine at the other end of opening 26*b*. As shown with an arrow in FIG. 1, the air current flows upward through bore 26. Therefore, the greater part of fuel emitting from the jet orifice 28 of said nozzle 22 is supplied to said engine together with the air current, but a part of the fuel from said emission orifice 28 falls to the bottom of concavity 20*a* rather than out of the opening 26*b*.

However, with the present invention, the fuel in the concavity 20*a* does not stay in the venturi bore 26 even during a long period of time at the idling position as shown in FIG. 1 because the collected fuel is sucked into the engine in sequence through the interior of the throttle valve 14 formed of the porous material. Consequently, even when the carburetor 10 is turned upside down from the position shown in FIG. 1, there is no great quantity of fuel to be suddenly sucked into the engine as previously happened to cause the engine to stop. Since said throttle valve 14 is made of porous material, it allows a slight amount of air flow through the throttle valve 14 by said suction negative pressure. Because of a strong air resistance in the interior of the throttle valve 14, such a slight air current does not amount to so much that the RPM of the engine is increased. Thus, the system can maintain an idling condition very well.

What has been described pertains to an example where the entire throttle valve 14 is made of porous material, and thus the entire exterior circumference of the throttle valve 14 is provided with porous material. However, an embodiment is possible wherein only the exterior circumference of the rotary throttle valve in the area where said venturi bore opens can be provided with the same porous material as mentioned above.

Figure 3:
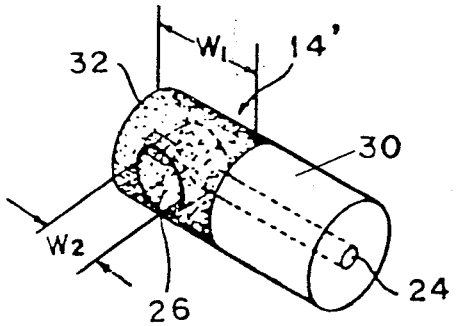
FIG. 3, a perspective view of a modified throttle valve.
Figure 4:
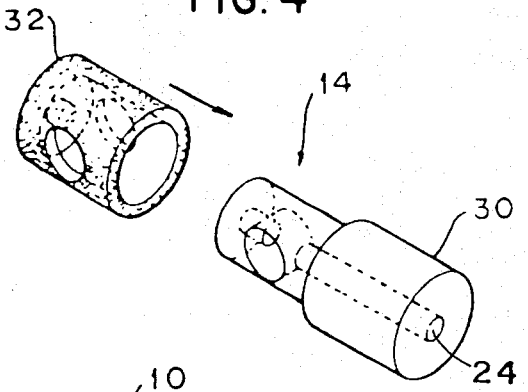
FIG. 4, an exploded view of the valve of FIG. 3.
Figure 5:
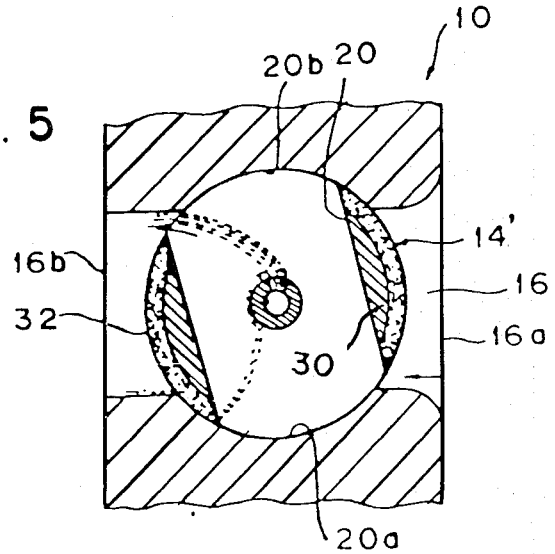
FIG. 5, a view similar to FIG. 1 but embodying the valve shown in FIGS. 3 and 4.

As shown in the examples illustrated in FIGS. 2 and 5, the rotary throttle valve 14' is composed of the body 30 of the same metallic material as has been used in the past for the existing rotary throttle valves, but a cylinder or sleeve of porous material 32 is fitted on to one smaller end of the said body 30. As shown in FIG. 3, the venturi bore 26 of the throttle valve 14' opens into the said porous material 32. As the fuel collects in the concavity 20*a*, it enters the sleeve of porous material 32 as shown in FIG. 5 and is sucked into the engine in the same way as described above. Thus, fuel does not collect in the concavity 20*a*. Although not illustrated, the same effect as mentioned above can be achieved when W1, the width dimension of the porous sleeve 32, is equal to dimension W2, the diameter of venturi bore, as shown in FIG. 3. In addition, the width dimension W1 can be a dimension smaller than dimension W2, the venturi diameter, depending on the corresponding diameter of the orifices of their coarseness of the porous material.

By putting the design into practice and as has been described, arranging that the exterior circumference of the rotary throttle valve where the venturi bore opens is composed of porous material, fuel which tends to get collected in the venturi bore will pass into and through the porous material, and is fed in sequence into the internal combustion engine. This eliminates fuel collection in the venturi bore, and idling operation of the internal combustion engine can be ideally controlled regardless of the orientation of the carburetor, that is, upright, upside down or sideways. The carburetor with this design can take advantage of the rotary throttle valve system carburetor and can be utilized by various kinds of internal combustion engine adaptations as the driving power source for chain saws or trimmers.

I claim:

1. In a carburetor utilizing a cylindrical valve with a venturi bore that opens in the direction of the diameter of the throttle valve and wherein portions of the valve serve as bearings in a carburetor body as the cylinder rotates, that improvement which comprises utilizing a cylindrical valve formed of porous material in the area of the venturi bore, the carburetor valve being formed as a cylinder of solid metal having one portion reduced in diameter where the venturi bore passes through the cylinder, and a sleeve of porous material on said reduced portion to complete the cylindrical valve.

* * * * *